United States Patent [19]

Crain

[11] 4,347,733

[45] Sep. 7, 1982

[54] BLOWOUT PREVENTOR TEST SYSTEM

[76] Inventor: Jack A. Crain, 107 Fabiola, Lafayette, La. 70508

[21] Appl. No.: 193,549

[22] Filed: Oct. 3, 1980

[51] Int. Cl.[3] ..... G01M 3/28

[52] U.S. Cl. ..... 73/40.5 R; 138/104

[58] Field of Search ..... 73/40.5 R, 49.1, 37; 138/44, 104; 285/239; 29/157 R

[56] References Cited

U.S. PATENT DOCUMENTS

| | | | |
|---|---|---|---|
| 3,733,903 | 5/1973 | Halmi | 138/44 X |
| 3,897,824 | 8/1975 | Fisher | 73/40.5 R X |
| 4,018,276 | 4/1977 | Bode | 73/40.5 R X |

*Primary Examiner*—Stuart S. Levy
*Assistant Examiner*—Joseph W. Roskos
*Attorney, Agent, or Firm*—Keaty & Keaty

[57] ABSTRACT

A blowout preventor test system utilizes a pipe nipple being threaded, for example, at both ends, and having a central bore through which fluid can be conveyed. At the central portion of the bore is a reduced orifice which constricts flow through the bore. Trapped through the walls of the nipple, on either side of the orifice, are instrumentation taps for attaching a differential pressure recording device having dual pins and a recorder chart. To ensure during testing of the BOP stack that each and every ram on a BOP or blowout preventor stack is properly tested, the orifice within the test nipple provides a restriction in flow which will be apparent from an inspection of the recorder chart. Different readings of pressure drop are produced by the test pin if in fact on each ram, the BOP stack is pressurized and exhausted. Thus, there is provided a means for the inspector to know whether or not each and every ram is inspected.

9 Claims, 3 Drawing Figures

BLOWOUT PREVENTOR TEST SYSTEM

BACKGROUND OF THE INVENTION

Field of the Invention

The present invention relates to a blowout preventor and methods of testing blowout preventors used in the drilling of oil and gas wells.

Even more particularly, the present invention provides a method for testing successive rams on a blowout preventor stack which test system discourages attempts to only test a single ram rather than each and every one.

General Background

In the control of oil and gas wells, blowout preventor stacks are known for the control of the well in the event that the well comes in too quickly to be controlled by the drilling mud which is normally used for such control. Often the BOP or blowout preventor stacks utilize a plurality of ram type preventors or annular type preventors. The safety of personnel working on an oil or gas drilling structure depends to a degree upon the precise operation of the blowout preventor stack. Thus, a testing of the stacks on a regular basis is desirable.

A problem in the testing of blowout preventor stacks involves the failure of personnel at the rig to spend the time and effort to test each and every ram or bag preventor in sequence. Indeed, the test could be run on a single ram and the same ram left shut and pressured up each time so that a chart or other instrumentation device with a recorder would appear to show a plurality of different tests, when in truth the same ram was in fact tested continually. It is to this problem that the present invention is directed.

General Discussion of the Present Invention

The present invention provides a test nipple apparatus for use in the testing of BOP or blowout preventor stacks. The present invention also provides a system for inspecting the testing of BOP stacks.

The present invention thus provides a BOP testing system in which a nipple is provided which has a central bore with an orifice installed in the bore. Instrumentation ports are provided on each side of the orifice with the nipple being installed in the line to bleed off the pressure from the blowout preventor stack after each test. A quick opening valve is installed on the end of the orifice nipple to release the pressure from the BOP and through the test nipple at the end of each test. The rate of opening of the valve would be the same for each test of each ram. A two pin bellows type chart recorder, for example, is used to record the test. One pin is attached by appropriate instrumentation lines to each side of the orifice nipple respectively to the pair of instrumentation ports which are provided in the wall of the test nipple and communicating with its bore. As the first ram or bag preventor of the blowout preventor stack is pressured up to a desired test pressure or PSI, the two pins will have the same pressure reading. The pressure is maintained on the blowout preventor stack for the desired test period (e.i., a number of minutes) after which the test is finished and the quick opening valve is opened to release pressure from the BOP stack. As this pressure is released, the instrumentation line to the pin on the downstream side of the orifice would experience a rapid pressure drop and record this pressure drop on the chart. The pin on the upstream side of the orifice will sense a slower drop in pressure as fluid bleeds off through the orifice giving a base line to follow on the other tests. Each ram or bag would be tested in order, in the same manner as above mentioned. The time distance of bleed-off will show the ram being tested. Any different type of fluid could be used to test the BOP stack including water, drilling mud, and the like with the more viscous or heavier fluids bleeding off through the orifice at slower time periods.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
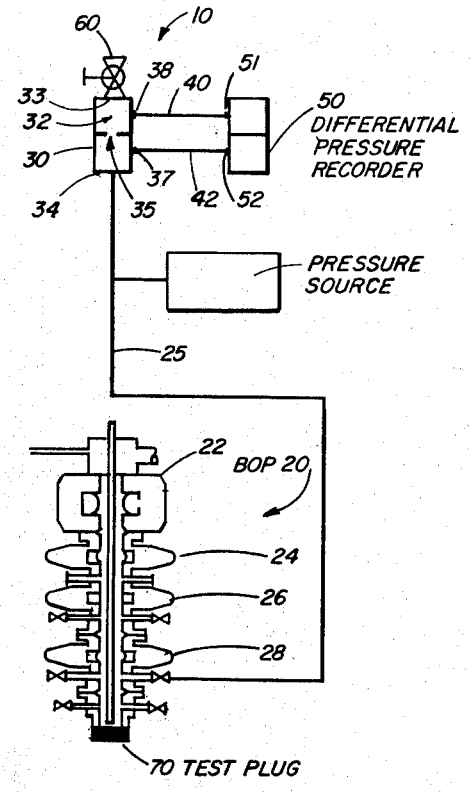
FIG. 1 s a schematic view of the preferred embodiment of the apparatus of the present invention.
Figure 2:
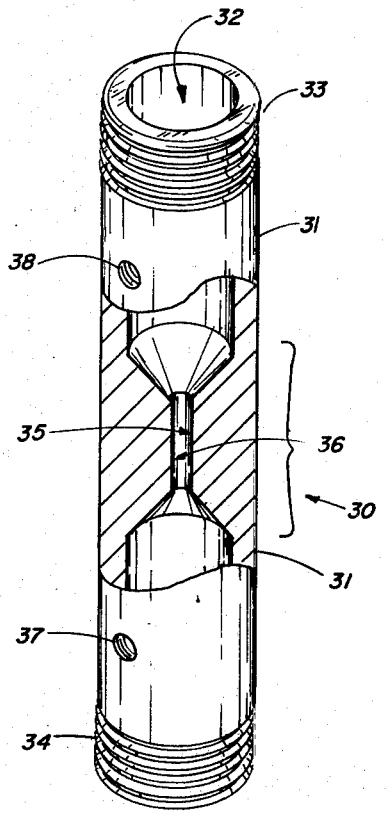
FIG. 2 is a perspective of partially cut away view of the test nipple portion of the preferred embodiment of the apparatus of the present invention.
Figure 3:
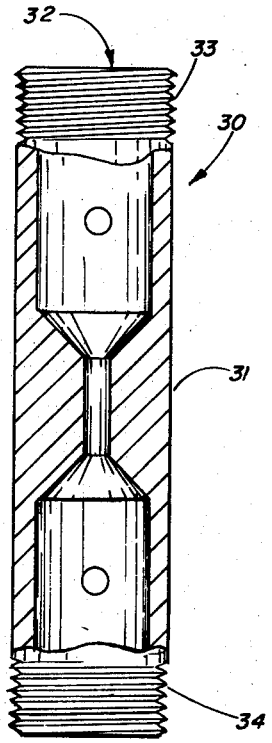
FIG. 3 is a sectional view of the preferred embodiment of the apparatus of the present invention illustrating the test nipple portion thereof.

FIGS. 1 through 3 illustrate the preferred embodiment of the apparatus of the present invention designated generally by the numeral 10. FIG. 1 provides a schematic illustration of a blowout preventor or BOP stack 20 which is being tested. BOP stack 20 would be connected through suitable instrumentation lines designated schematically as 25 in FIG. 1, to test nipple 30, which is more particulary shown in FIGS. 2 and 3.

In FIG. 1, nipple 30 provides an inner bore 32 which at its central portion is of reduced diameter at orifice 35. Instrumentation lines 40, 42 connect at one end portion to nipple 30 respectively at ports 37, 38 and connect at their other end portion to recorder 50 which could be, for example, a bellows type differential pressure recorder which is commercially available and conventional differential pressure recorder. A quick opening valve 60 attaches to nipple 30 at end portion 33 while instrumentation line 25 completes a connection of BOP 20 to nipple 30 at end portion 34 of nipple 30.

Connections 51, 52 are provided on differential pressure recorder 50 which allow for the attachment respectively of the instrumentation line 40, 42 thereto.

FIGS. 2 and 3 show more particularly the construction of nipple 30. Nipple 30 provides a cylindrical annular wall 31 which defines therewithin a continuous bore 32. Bore 32 is provided from threaded end portion 33 of nipple 30 to the other end portion 34 thereof.

A thickened portion of wall 31 is provided at the central portion of bore 32 which thickened zone is indicated in FIG. 2 as 36. This thickened portion defines an orifice 35 which as will be described more fully hereinafter provides a constriction for flow traveling through bore 32 between threaded end portions 34, 33.

Returning to FIG. 1 in the drawings, there can be seen BOP stack 20 which normally would be comprised of a plurality of rams which are indicated in FIG. 1 as annular ram 22, top pipe ram 24, blind ram 26, and bottom ram 28. These rams are tested sequentially by closing each individual ram in sequence during its testing and putting a test plug at the bottom of the BOP stack which plug is indicated in FIG. 1 as test plug 70.

When each ram in sequence is closed, the area below it pressurized for a period of time, with the area between the test plug and the particular closed ram being pressurized with fluid (water, drilling mud or the like).

Each sequential ram is then closed and subjected to pressurization in order to test it. Each ram 22–28 or annular preventor bag is thus tested in order and in the same manner. The time difference of bleed-off will show, with the rams being tested in this sequential fashion. This is because the first instrumentation line 40 adjacent valve 60 will drop the pressure rapidly while line 42 will drop in pressure slowly because of the constriction provided in the form of orifice 35.

Nipple 30 could be of any suitable structural material such as steel or the like as is known the construction of pipe with a heavy duty wall thickness being preferable.

Or in one example constriction, nipple 30 was a 12 inch long by 2 inch diameter nipple having one-fourth inch NPT threads and being threaded at each end.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A testing apparatus for a blowout preventor comprising:

a. a test nipple having cylindrical wall defining therewithin a flow conveying bore;

b. bore constriction means placed at the central portion of said bore for restricting flow through said bore;

c. a pair of openings provided in said nipple for porting said nipple respectively on each side of said orifice;

d. instrumentation means for connecting one end portion of said nipple to a blowout preventor;

e. valve means at the opposite end portion of said nipple for releasing pressure from said nipple; and f. a pair of instrumentation lines connected respectively to said pair of openings, the opposite end portion of each of said respective instrumentation lines being connected to a differential pressure recorder.

2. The testing apparatus of claim 1, wherein said bore constriction means is an orifice placed at the central portion of said bore.

3. The testing apparatus of claim 1, wherein said a pair of openings are a pair of ports provided respectively on each side of said orifice with each port providing an opening into said nipple bore through the wall portion thereof.

4. The testing apparatus of claim 1, wherein said valve means is a valve attached at one end portion of said nipple.

5. The testing apparatus of claim 4, wherein said valve is a quick opening valve.

6. The testing apparatus of claim 1, wherein said instrumentation means is an instrumentation line connecting said nipple hydraulically to the inner portion of said blowout preventor.

7. A testing nipple for use with testing of blowout preventors comprising:

a. a test nipple body having a cylindrical wall defining therewithin a flow conveying bore;

b. an orifice mounted at the central portion of said bore, said orifice providing a constriction to said bore;

c. first and second port means provided through the wall portion of said nipple on each side respectively of said orifice, each of said ports providing attachment means for attaching an instrumentation line thereto;

d. BOP instrumentation attachment means on one end portion of said nipple for forming a hydraulic connection with the inner portion of a BOP stack;

e. second attachment means at the opposite end portion of said nipple for attaching said nipple to a quick opening valve.

8. The testing apparatus of claim 7, wherein said nipple is threaded at each end portion.

9. A method for testing blowout preventors comprising the steps of:

a. providing a test nipple having a cylindrical wall and defining therewithin a flow conveying bore, said bore being constricted at the central portion thereof;

b. attaching one end portion of that nipple hydraulically to the central portion of a blowout preventor;

c. monitoring differential pressure in said nipple on each side of said bore;

d. sealing the opposite end portion of said nipple during pressurization of the BOP stack; and e. monitoring the pressure drop on each side of the bore when the nipple is unsealed allowing pressure to vent through the nipple from the BOP stack.

* * * * *